US009441625B2

(12) United States Patent
Schoendorff

(10) Patent No.: US 9,441,625 B2
(45) Date of Patent: Sep. 13, 2016

(54) SYSTEM AND METHOD FOR PUMP COMPONENT CONTROLLING AND TESTING

(71) Applicant: Arthur Joseph Schoendorff, Chicago, IL (US)

(72) Inventor: Arthur Joseph Schoendorff, Chicago, IL (US)

(73) Assignee: Mary Ann Schoendorff, Chicago, IL (US)

( * ) Notice: Subject to any disclaimer, the term of this patent is extended or adjusted under 35 U.S.C. 154(b) by 352 days.

(21) Appl. No.: 14/153,002

(22) Filed: Jan. 11, 2014

(65) Prior Publication Data

US 2014/0199180 A1 Jul. 17, 2014

Related U.S. Application Data

(60) Provisional application No. 61/751,279, filed on Jan. 11, 2013.

(51) Int. Cl.

| | |
|---|---|
| ***G05B 13/00*** | (2006.01) |
| ***G05B 15/00*** | (2006.01) |
| ***G05D 23/00*** | (2006.01) |
| ***G05D 11/00*** | (2006.01) |
| ***F04B 49/00*** | (2006.01) |
| ***F04B 43/12*** | (2006.01) |
| ***F04B 49/06*** | (2006.01) |
| ***F04B 35/00*** | (2006.01) |
| ***F04B 17/00*** | (2006.01) |
| ***F04B 51/00*** | (2006.01) |

(52) U.S. Cl.

CPC ..... *F04B 51/00* (2013.01)

(58) Field of Classification Search

CPC ..... G05B 15/02; G01F 23/18; G05D 9/12; F04D 13/06; F04D 13/08; F04D 15/00; F04D 15/02; F04D 29/40; F04B 17/06; F04B 17/02; F04B 17/03; F04B 23/02; F04B 47/06; F04B 47/02; F04B 49/10; F04B 49/08; F04B 49/06; F04B 49/02; F02B 63/04; F16N 29/02; F02M 37/22; F17D 3/01; H04L 43/08

USPC ..... 137/2

See application file for complete search history.

(56) References Cited

U.S. PATENT DOCUMENTS

| | | | |
|---|---|---|---|
| 3,264,627 | A | 8/1966 | Austin |
| 3,941,507 | A | 3/1976 | Niedermeyer |
| 4,087,204 | A | 5/1978 | Niedermeyer |
| 4,228,427 | A | 10/1980 | Niedermeyer |

(Continued)

*Primary Examiner* — Mohammad Ali
*Assistant Examiner* — MD Azad
(74) *Attorney, Agent, or Firm* — Nyman IP LLC; Scott Nyman

(57) ABSTRACT

A system and method that provides an electronic controller module (ECM) that is bi-directionally communicable with a system monitor via a network to control and test pump components. Communication between the ECM and the system monitor may include receiving an operate command, receiving a report command, transmitting status, testing the pump components, monitoring sensors, and otherwise controlling the ECM via the system monitor. The ECM may communicate via the Internet, which may be facilitated by a router. The system monitor may provide advanced analytics, monitoring, maintenance, and reporting. The pump components may include one or more primary pumps and a backup pump, which may be battery operated. The sensor may include a float and sensor for a motor of the pump. The motor may be located in a sump. The ECM may perform timed tests.

15 Claims, 6 Drawing Sheets

(56) References Cited

U.S. PATENT DOCUMENTS

| | | | | |
|---|---|---|---|---|
| 4,369,438 | A | 1/1983 | Wilhelmi | |
| 4,437,811 | A | 3/1984 | Iwata et al. | |
| 4,652,802 | A | 3/1987 | Johnston | |
| 5,672,050 | A | 9/1997 | Webber | |
| 6,188,200 | B1 | 2/2001 | Maiorano | |
| 6,676,382 | B2 | 1/2004 | Leighton | |
| 7,309,216 | B1 | 12/2007 | Spadola | |
| 7,429,842 | B2 | 9/2008 | Schulman | |
| 8,392,561 | B1 | 3/2013 | Dyer | |
| 2003/0125852 | A1* | 7/2003 | Schade | H04L 43/0817 701/33.4 |
| 2005/0281679 | A1 | 12/2005 | Niedermeyer | |
| 2007/0258827 | A1 | 11/2007 | Gierke | |
| 2008/0031751 | A1* | 2/2008 | Littwin | F04B 47/06 417/411 |
| 2009/0060751 | A1 | 3/2009 | Bourell | |
| 2009/0208345 | A1* | 8/2009 | Moore | F04D 15/0077 417/6 |
| 2011/0311370 | A1* | 12/2011 | Sloss | F04B 47/02 417/1 |
| 2012/0251333 | A1 | 10/2012 | Irwin | |
| 2013/0185786 | A1 | 7/2013 | Dyer | |
| 2014/0119947 | A1* | 5/2014 | Bishop | F04B 17/06 417/14 |

* cited by examiner

SYSTEM AND METHOD FOR PUMP COMPONENT CONTROLLING AND TESTING

CROSS-REFERENCE TO RELATED APPLICATION

This application claims the priority from U.S. provisional patent application Ser. No. 61/751,279 filed Jan. 11, 2013, which application is hereby incorporated by reference into this application in its entirety.

FIELD OF THE INVENTION

The present invention relates to the technical field of electronics. More particularly, the present invention relates the technical field of electronic control and monitoring of connected components.

BACKGROUND

Electric motors impact almost every aspect of our lives. Pumps, refrigerators, vacuum cleaners, air conditioners, air handlers in furnaces, exhaust fans for furnaces, virtually all fans of nearly every kind, computer hard drives, automatic car windows, and a multitude of other appliances and devices use electric motors to convert electrical energy into mechanical energy. Additionally, electric motors are also responsible for a very large portion of industrial processes. Electric motors are used heavily at some point in the manufacturing process of nearly every product produced in modern factories. When these motors fail, problems result.

Electric motors have long been used to drive pumps. A sump pump is often the first line of defense against rain water, water heater failure, or a plumbing failure. A sump pump may fail for many reasons, which can cause flooding and damage. Many factors can cause a sump pump to operate incorrectly. The most common cause of failure or incorrect operation is the age of the pump. Additionally, while the life of a sump pump has an impact on its operation, failure or incorrect operation is often caused by an amount the pump is used and the quality of the water being pumped. The average sump pump typically fails within five to seven years. With heavy usage, that pump life can be cut dramatically.

Another cause of failure for pumps is dirty water. Sump pumps can become clogged when materials in the water that are too big and block screens that allow the water into the intake of the sump pump. Blockage of this water often causes the pump to operate incorrectly. Sump pumps also fail because due to electrical problems, such as when electricity is improperly provided to the pump. For example, a storm may cause a power failure causing a pump connected to the grid to not function. Unfortunately, a nonoperational sump pump will often be needed most during a heavy storm.

Some solutions attempt to overcome problems with operating a sump pump during a power failure by including a battery. However, many problems plague the attempted solutions of the prior art. For example, batteries often fail to maintain a charge. Similarly, charging circuitry or an inverter unit can fail, leaving the battery without charge. Additionally, pump switches can fail, can operate incorrectly due to improper installation, or could otherwise be faulty and cause a pump to fail when need most. Other problems related to pump systems can occur, such as vapor locks, frozen pump impellers, backwards check valves, improper water discharge, and numerous other causes of failure. Often, pumps "freeze" up because they have not been activated in a long time.

No solution presently exists that solves the problems discussed above. However, several solutions have been proposed out of desire prevent pump failure, but ultimately fail tosolve the problems with the current state of the art. As an example, Metropolitan's Ion GenesisPump Controller product attempts to test a pump, but does not actually turn the pumps on fortesting and instead inadequately monitors a water level to report whether the pumps are notworking properly. Additionally, Glentronic's Deluxe Float Controller product only turns on oneprimary pump to "exercise" it, but is disadvantageously unable to detect if a pump has failed. NexPump's AiJet product attempts to test a pump, but is only compatible with a limited range of proprietary primary and/or BOSP pumps. Furthermore, a PeakFlow system product attempts to test a pump, but is limited to testing only one specific pump.

What is needed is a central controller module for controlling and monitoring universal pump components. What is needed is a testing and monitoring system to determine an operational status of a pump component. What is needed is a testing and monitoring system that is universally operable with a variety of pumps, battery systems, and other pump components. What is needed is a system capable of waking a pump to perform diagnostics and monitor an operational condition. What is needed is a system that can communicate a status and/or condition of the pump to a system monitor via a network. What is needed is a device to allow for remote monitoring of a pump and pump components by a service company. What is needed is a system capable of accommodating, controlling, diagnosing, and monitoring of multiple pumps substantially simultaneously. What is needed is a method of operating the system to diagnose and monitor operation of a pump and/or pump components.

SUMMARY

The system and method of the invention is capable of universally controlling and monitoring pump components, including virtually all of types of motors operable by the system, which may be AC and/or DC motors. The system of the present invention may include and/or integrate a controller module to control, diagnose, and monitor primary and backup pump components of a pump system. According to an embodiment of the present invention, the pump system may be a sump pump system. The system may integrate control, diagnostic, and other components into a unified module, such as an electronic controller module (ECM). The ECM may include an interface that provides operational flexibility and may accommodate software for monitoring components sourced from various manufactures and/or model lines. The ECM may include resilient components, for example, such as used in the security industry.

The control and testing system of the present invention may be advantageously accessible via a network. Additionally, the system may be controlled, updated, or otherwise manipulated remotely. Software operable on the ECM may be updated, modified, or switched. Updating or switching from one software to another may be necessary if a software is found to be inadequate, or if the software may be upgraded to a new version.

The ECM may provide feedback, for example, as signals or messages. The system may include a system monitor to monitor the ECM messages and determine the status of a pump and other pump components. In complex installations of the pump and related components, the ECM may be configured with significant information technology ("IT") resources and sophisticated software support. The ECM may support multiple different alert messages for each household, each of which may be received, stored, indexed, and appropriately monitored. ECM messages may be analyzed by the system, which may result in correspondences, such as mobile text alerts or emails, to homeowners, reporting a status of the pump and/or pump components. Additionally, messages may initiate a maintenance request and/or be reported to agents of a system to contact an owner of a pump regarding status or alerts. Messages may be stored for analytic and reporting purposes.

The universal pump component control and testing system and method of the present invention advantageously provides a central control module for controlling and monitoring universal pump components. The present invention advantageously provides a control, testing, and monitoring system to determine the operational status of a pump component. Additionally, the present invention advantageously provides a system that is universally operable with a variety of pumps, battery systems, and other pump components. The present invention also advantageously provides a system capable of waking a pump to perform diagnostics and monitor an operational condition. Moreover, the present invention advantageously provides a system that can communicate a status and/or condition of the pump to a computerized device via a network. The present invention advantageously provides a system to allow remote monitoring of a pump and pump components by a service company. Furthermore, the present invention advantageously provides a system capable of accommodating, controlling, diagnosing, and monitoring of multiple pumps substantially simultaneously. The present invention advantageously provides a method of operating the system to control, diagnose, and monitor operation of a pump and/or pump components.

According to an embodiment of the present invention, a system is provided to control and test pump components. The system may include a system monitor and an electronic controller module (ECM). The ECM may control and test the pump components. The ECM may be bi-directionally communicable with the system monitor via a network. The ECM may be capable of initiating a test after elapse of a duration. Communication between the ECM and the system monitor may include receiving an operate command by the ECM from the system monitor to operate the pump components, a condition of the pump components being measurable during a test that operates the pump components. Communication between the ECM and the system monitor may also include receiving a report command by the ECM from the system monitor to report a status and transmitting the status by the ECM to the system monitor. The ECM may be communicably connectable to a sensor that senses the condition. If the test determines the condition is within an acceptable operational range, the ECM may communicate a signal indicative of compliance to the system monitor. If the test determines the condition is not within the acceptable operational range, the ECM may communicate a signal indicative of an error to the system monitor. The system monitor may performs the steps: monitoring the signal provided by the ECM; analyzing the status reported by the ECM; if the status includes the error, determining whether to initiate a maintenance request in response to the error and initiating the maintenance request when determined to be necessary; and if the status includes the error, determining whether to report the error to a user and reporting the error when determined to be necessary. The pump components may be manually controllable to override control by the ECM.

In another aspect, the network may include the Internet. The system monitor may include a database operatively connected via the network. A profile may be storable in the database to include information relating to the ECM and the pump components operated at an installation location. The profile may include historical data for determining analytics.

In another aspect, the ECM may communicate with a router via a local area network, wherein the router directs communication between the ECM and the system monitor via the Internet, and wherein the ECM is updatable by the system monitor via the network.

In another aspect, the profile may be serviceable by the system monitor to monitor the ECM and report feedback to a user. The profile may further include billing information. Service provided by the system monitor may be monetized by requiring a subscription.

In another aspect, the system may include the pump components. The pump components may include a motor includable in a pump, a battery, and a power source; wherein the motor is locatable in a sump.

In another aspect, the pump components may include a primary pump connected to a primary power source of alternating current and a backup pump connected to a backup power source.

In another aspect, the primary pump may include a first primary pump and a second primary pump. The first primary pump may be driven by a first power circuit of the primary power source. The second primary pump may be driven by the first primary circuit or a second primary circuit of the primary power source. The first primary pump and the second primary pump may be operable substantially simultaneously. The backup pump may be driven by the primary power source, the backup power source, or a combination of the primary power source and the backup power source.

In another aspect, the system may include the sensor. The sensor may include a motor sensor, a battery sensor, a water level sensor, and a power sensor.

In another aspect, a display may be operatively connectable to the ECM to provide feedback and wherein a keypad may be operatively connectable to the ECM to at least partially control the system.

According to an embodiment of the present invention, a system is provided to test pump components. The system may include a system monitor, pump components, a sensor, and an electronic controller module (ECM). The system monitor may include an operatively connected database to store a profile including information about the system operated at an installation location and historical data for determining analytics. The pump component may include a motor includable in a pump, a battery, and a power source. The sensor may include a motor sensor, a battery sensor, a water level sensor, and a power sensor. The ECM may control and test the pump components. The ECM may be bi-directionally communicable with the system monitor via a network communicable over Internet. The ECM may be capable of initiating a test after elapse of a duration. Communication between the ECM and the system monitor may include receiving an operate command by the ECM from the system monitor to operate the pump components, a condition of the pump components being measurable during a test that operates the pump components; receiving a report command by the ECM from the system monitor to report a status; and transmitting the status by the ECM to the system monitor. If the test determines the condition is within an acceptable operational range, the ECM may communicate a signal indicative of compliance to the system monitor. If the test determines the condition is not within the acceptable operational range, the ECM may communicate a signal indicative of an error to the system monitor. The ECM may communicate with a router via a local area network. The router may direct communication between the ECM and the system monitor via the Internet. The ECM may be communicably connectable to the sensor. The pump components may be manually controllable to override control by the ECM. The motor is locatable in a sump.

In another aspect, the system monitor may perform the steps: monitoring the signal provided by the ECM; analyzing the status reported by the ECM; if the status includes the error, determining whether to initiate a maintenance request in response to the error and initiating the maintenance request when determined to be necessary; and if the status includes the error, determining whether to report the error to a user and reporting the error when determined to be necessary.

In another aspect, the ECM may be updatable by the system monitor via the network. The profile may be serviceable by the system monitor to monitor the ECM and report feedback to a user. The profile may include billing information, and wherein service by the system monitor is monetized by requiring a subscription.

In another aspect, the pump components may include a primary pump connected to a primary power source of alternating current and a backup pump connected to a backup power source.

In another aspect, the primary pump may include a first primary pump and a second primary pump. The first primary pump may be driven by a first power circuit of the primary power source. The second primary pump may be driven by the first primary circuit or a second primary circuit of the primary power source. The first primary pump and the second primary pump may be operable substantially simultaneously. The backup pump may be driven by the primary power source, the backup power source, or a combination of the primary power source and the backup power source.

In another aspect, a display may be operatively connectable to the ECM to provide feedback and wherein a keypad may be operatively connectable to the ECM to at least partially control the system.

According to an embodiment of the present invention, a method is provided to operate a system for testing pump components, the system including an electronic controller module (ECM) that is bi-directionally communicable with a system monitor via a network. The method includes (a) establishing a communication over the network between the ECM and the system monitor, the network being communicable over Internet. The method additionally includes (b) monitoring a sensor communicably connected to the ECM to determine a condition of the pump components. The method includes (c) testing the pump components, wherein testing is initiated by a command from the system monitor or the ECM, the testing that is initiated by the system monitor further including (i) receiving an operate command by the ECM from the system monitor to operate the pump components, the condition of the pump components being measurable during a test that operates the pump components, (ii) receiving a report command by the ECM from the system monitor to report a status, and (iii) transmitting the status by the ECM to the system monitor, wherein if the test determines the condition is within an acceptable operational range, the ECM communicates a signal indicative of compliance to the system monitor, and wherein if the test determines the condition is not within the acceptable operational range, the ECM communicates a signal indicative of an error to the system monitor. The method may additionally include (d) processing the status using the system monitor, which further includes (i) monitoring for the signal provided by the ECM, (ii) analyzing the status reported by the ECM, (iii) if the status includes the error, determining whether to initiate a maintenance request in response to the error and initiating the maintenance request when determined to be necessary, and (iv) if the status includes the error, determining whether to report the error to a user and reporting the error when determined to be necessary. The pump components may be manually controllable to override control by the ECM.

In another aspect of the method, the system monitor may include a database operatively connected via the network. A profile may be storable in the database. The profile may include information relating to the ECM and the pump components operated at an installation location, historical data for determining analytics, and billing information. The profile may be serviceable by the system monitor to monitor the ECM and report feedback to a user requiring a subscription for monetization. The ECM may be updatable by the system monitor via the network. The operation of step (a) may further include (i) communicating by the ECM with a router via a local area network, and (ii) directing the communication between the ECM and the system monitor via the Internet using the router.

In another aspect, the pump components may include a motor includable in a pump, a battery, and a power source; wherein the motor is locatable in a sump. The sensor may include a motor sensor, a battery sensor, a water level sensor, and a power sensor.

In another aspect, the pump components may include a primary pump connected to a primary power source of alternating current and a backup pump connected to a backup power source. The primary pump may further include a first primary pump and a second primary pump. The first primary pump may be driven by a first power circuit of the primary power source. The second primary pump may be driven by the first primary circuit or a second primary circuit of the primary power source. The first primary pump and the second primary pump may be operable substantially simultaneously. The backup pump may be driven by the primary power source, the backup power source, or a combination of the primary power source and the backup power source.

In another aspect, a display is operatively connectable to the ECM to provide feedback and wherein a keypad is operatively connectable to the ECM to at least partially control the system.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
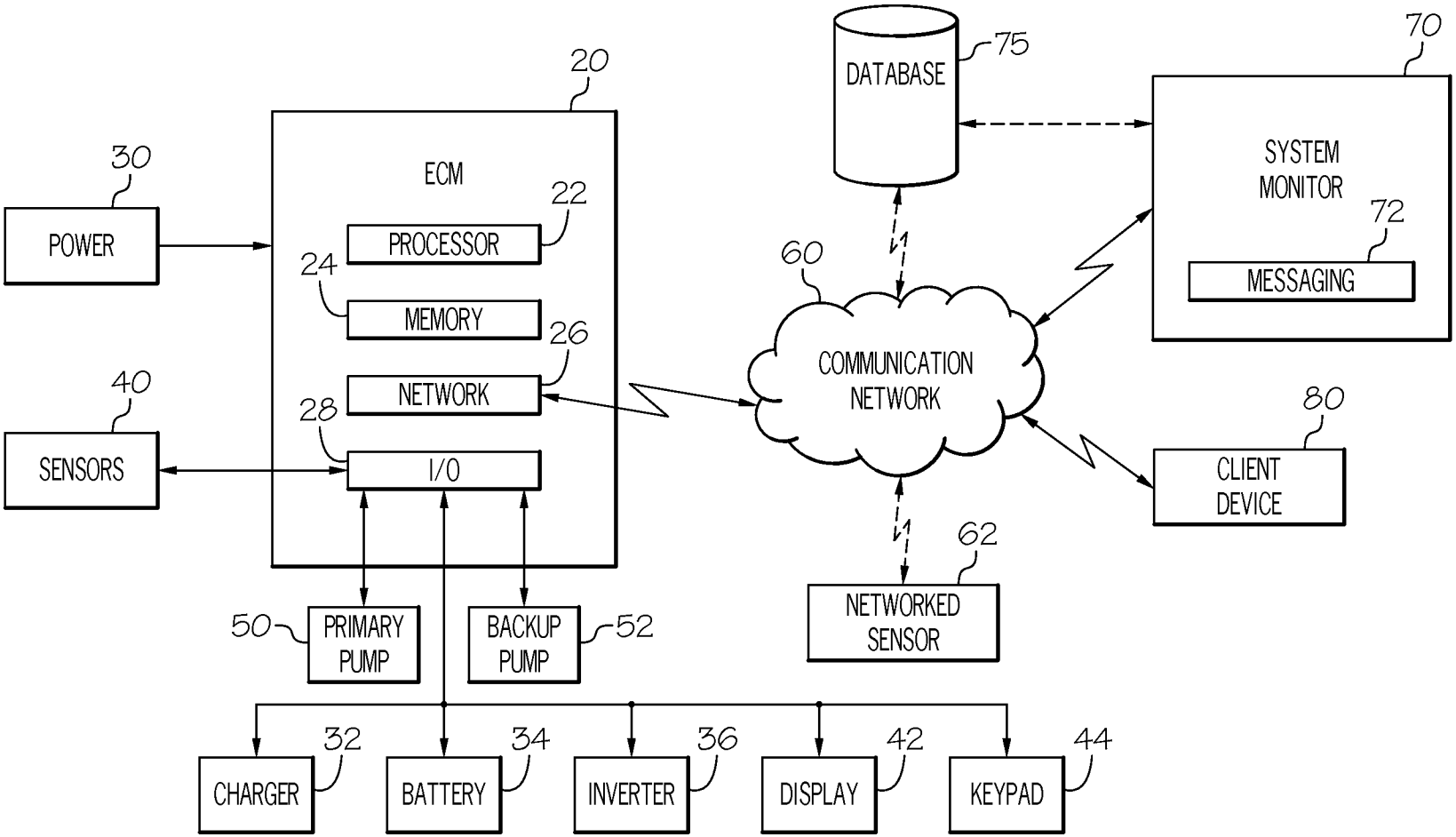
FIG. 1 is a block diagram of an illustrative system, according to an embodiment of the present invention.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The invention provides a system usable to control, monitor, and test pump components. For example, the system of the present invention may be used to control, monitor, and test components of a sump pump configuration. Throughout this disclosure, the invention will be discussed in the context of a system for controlling and testing a sump pump and related pump components. Skilled artisans will appreciate additional applications of the present invention, and should not view this disclosure to limit the present invention to the examples provided below. Pump components may include a motor includable in a pump, a battery, a power source, relays, and/or other components usable with a pump.

The system may include an electronic control module (ECM) as a central connection point for all components of the system. The system may relate to a sump pump system. Ordinarily, primary and secondary pumps are connected independently and operate independently of each other. The system of the present invention advantageously controls the primary and secondary pumps from a central ECM.

A central control aspect of the present invention advantageously allows use of all sensors to ascertain whether a high water level exists and to operate any or all pumps if needed, even if one of the several water level sensors should fail. This feature increases the system reliability using the same number of components, by virtue of the logic made possible by a central connection point, i.e. the ECM. The central control aspect also advantageously allows a user to manually operate his or her several sump pumps, for example, by using manual toggle switches on the ECM module. Manual operation may be used either as a test of the system or to force the pumps to operate if they do not otherwise operate due to some failure of the pump system, such as failure of a pump and/or sensor.

The system may control a number of pump components. Throughout this disclosure, examples are discussed that include two primary pumps and a backup pump. Additional examples are provided describing a primary power source with two power circuits. Although two separate AC power circuits can be comprehended with the system, if desired by a user for additional system reliability, it is not necessary to have both circuits in order for the system to operate.

The system monitor may be physically located on a remote server connected to the Internet, which may be common to all customers using an ECM of the system. The system monitor may be maintained and operated by a service provider company, which may also perform installation of the ECMs at an installation location, such as in a user's home. An installation may be performed by a designated service provider. The system may be monitored on a subscription basis to provide monitoring service to the customers. The ECM may provide periodic programmed testing of the pumps, without needing to be initiated by the system monitor. But testing and operation of pump components can also be commanded remotely via the system monitor. The system monitor is also capable of uploading system software and software changes to all ECMs via the internet connection.

The ECM and system monitor can operate even with a basic system containing only one primary pump and no backup pumps. Alternatively combination of primary pumps and backup pumps (for example, a DC motor type or AC motor type with inverter) can be comprehended by the ECM and system monitor.

The system may use various types of water level sensors, including a conventional float switch and a modified conventional float switch that contains a shunt resistor. The shunt resistor enables the ECM to determine whether the water level sensor is connected to the ECM or not. An installer of the system may program the ECM via a keypad to know which type of sensor is being used. Additionally, the ECM electronics may allow use of non-float type water level sensors or another type of sensor.

The system monitor function, in addition to its system functional capability, is also used to provide business level functions, including automatic billing to customers for monthly monitoring fees and to auto debit/credit card accounts and route the payments to the provider of the monitoring service. The system monitor may provide reports on demand to the provider as to the status of customer's payments for monitoring.

Additionally, the system provides other benefits, such as accumulating history of system performance over a period of time to determine analytics. Analytics may include operational status of a system, historical usage history, efficiency, errors, how often a user's pump components operate, and other information. The analytics can reflect how often a system should be checked and how often a system may need to replace pump motors, water level sensors and/or switches, or batteries, as a function of usage. The analytics advantageously facilitate replacement of failing components before a flood occurs. Additionally, the system monitor may use the analytics to remotely turn on a user's pumps upon an expected event, for example, when a known flooding exists or when the system monitor recognizes that a customer's pumps are not activating on their own. Flooding may be determined by weather forecasts, installation location details, historical usage data, or other information that may be included in a profile associated with a user's installation. Direct economic benefits are associated with this monitoring capability.

Generally, the system of the present invention may include pump components, sensors, an electronic control module (ECM), and a system monitor accessible via a network. Referring now to the block diagram of FIG. 1, an illustrative configuration of the system will now be discussed. As discussed above, the system may include an ECM 20, system monitor 70, pump components, and sensors 40. The ECM 20 and the system monitor 70 may communicate via a network 60. The system monitor 70 may be communicatively connected to a database 75 directly, via the network 60, or via another connection that would be apparent to a person of skill in the art. The system monitor 70 may include a messaging component 72 to submit a maintenance request and/or transmit one or more message to a user regarding status or an error.

The ECM 20 may include a processor 22, memory 24, network controller 26, and optionally an input/output (I/O) controller 28. Skilled artisans will appreciate additional embodiments of an ECM that may omit one or more of the aforementioned components or include additional components without limitation. The processor 22 may receive and analyze data. The memory 24 may store data, which may be used by the processor 22 to perform the analysis. The memory 24 may also receive data indicative of results from the analysis of data by the processor 22.

The memory 24 may include volatile memory modules, such as random access memory (RAM), and/or non-volatile memory modules, such as flash based memory. Skilled artisans will appreciate the memory to additionally include storage devices, such as, for example, mechanical hard drives, solid state drives, and removable storage devices.

The ECM 20 may also include a network controller 26. The network controller 26 may receive data from other components of the ECM 20 and/or system to be communicated with other computerized devices via the network 60, such as the system monitor 70. The communication of data may be performed wirelessly. More specifically, without limitation, the network controller 26 may communicate and relay information from one or more components of the system, or other devices and/or components connected to the system, to additional connected devices. Connected devices are intended to include data servers, additional computerized devices, mobile computing devices, smart phones, tablet computers, networked sensors 62, databases 75, client devices 80, and other electronic devices that may communicate digitally with another device.

The ECM 20 may also include an I/O interface 28. The I/O interface 28 may be used to transmit data between the ECM 20 and extended devices. Examples of extended devices may include, but should not be limited to, a display 42, keypad 44, charger 32, battery 34, AC power component 36, for example, an inverter, sensors 40, primary pumps 50, backup pump 52, external storage device, human interface device, printer, sound controller, or other components that would be apparent to a person of skill in the art. Sensors 40 may include a motor sensor, battery sensor, water level sensor, power sensor, and other sensors. Additionally, one or more of the components of the ECM 20 may be communicatively connected to the other components via the I/O interface 28.

The ECM 20 may be connected to a power source 30. The power source 30 may supply power to the ECM 20, connected pump components, sensors 40, battery 34, charger 32, inverter 36, display 42, keypad 44, and other components of the system. The pump components may include a battery 34, charger 32, primary pump 50, backup pump 52, and other components. The power source 30 will be discussed later in this disclosure in greater detail.

The components of the ECM 20 may interact with one another via a bus. Those of skill in the art will appreciate various forms of a bus that may be used to transmit data between one or more components of an electronic device, which are intended to be included within the scope of this disclosure.

The ECM 20 may communicate with one or more connected device, such as a remote system, modem, or router, via a network 60. The ECM 20 may communicate over the network 60 by using its network controller 26. More specifically, the network controller 26 of the ECM 20 may communicate with the network controllers of the connected devices. The network 60 may be, for example, the Internet. In one example, the network controller 26 of the ECM 20 may communicate with a wireless router, which may route a communication through the Internet to a connected device, such as the system monitor 70. As another example, the network may be a local area network (LAN), such as a wireless local area network (WLAN). However, skilled artisans will appreciate additional networks to be included within the scope of this disclosure, such as intranets, wired local area networks, wide area networks, peer-to-peer networks, and various other network formats. Additionally, the ECM 20 and/or connected devices may communicate over the network 20 via a wired, wireless, or other connection, without limitation.

The electronic control module (ECM) 20 will now be discussed in greater detail. The ECM may include electronic components to receive input data, analyze the data, and transmit signals to other electronic devices. The ECM may be used to interface with a system monitor, which will be discussed below in greater detail. The ECM may additionally control one or more pump components, such as a motor of a pump used to remove liquid from a sump.

Figure 2:
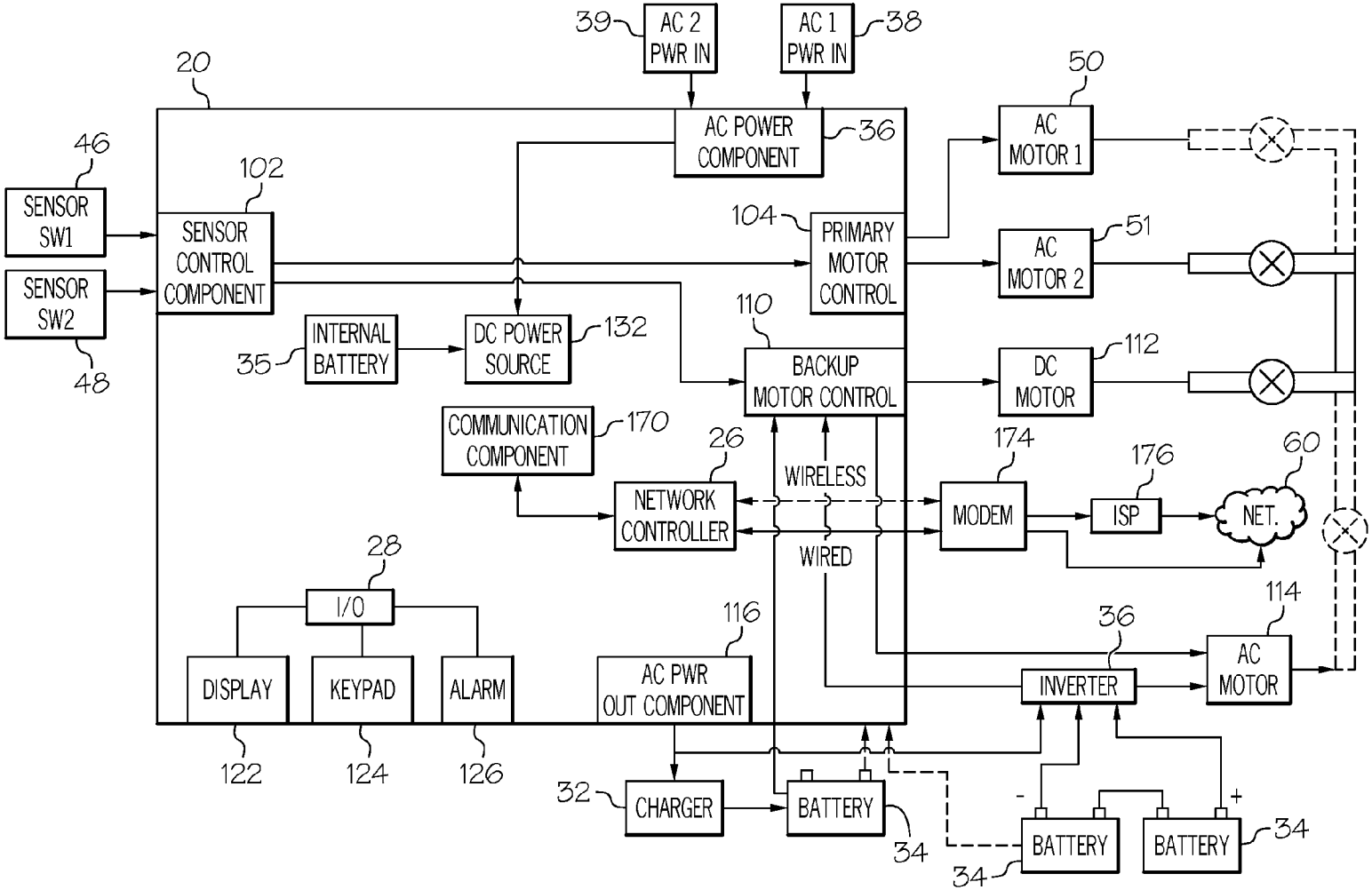
FIG. 2 is a block diagram of an illustrative electronic controller module, according to an embodiment of the present invention.

Referring now to the block diagram of FIG. 2, an illustrative ECM will now be discussed without limitation. Skilled artisans will appreciate alternative configurations of an ECM that would be applicable to the present invention after having the benefit of this disclosure. The following illustrative ECM is provided as an example to clearly illustrate an embodiment of the present invention, and is not intended to be limiting in any way.

The ECM 20 may include components for controlling, testing, communicating, providing feedback, and otherwise operating the system. Components the ECM 20 that may be included for operating the pump components of the system will now be discussed. The ECM 20 may include an alternating current (AC) power component 36, which may be used to operate, select, and test the power delivery to the different components of the system. The AC power component 36 may connect to one or more power source, which may be connected to a primary power source. The primary power source may include one or more power circuits. For example, the primary power source may include a first primary circuit 38 and a second primary circuit 39. Skilled artisans will appreciate additional circuits that may be connected to and/or controlled by the ECM 20.

The ECM 20 may additionally include a direct current (DC) power supply 132. The DC power supply may be operatively connected to the AC power component 36, and may receive power from the AC power component 36, for example, via an AC-DC conversion. The DC power supply 132 may provide electrical power used to drive the ECM 20. Additionally, the DC power supply 132 may provide electrical power to charge one or more battery 34, drive a DC backup motor 112, or otherwise power a DC electrical circuit. Feedback from the battery 34, such as a voltage feedback, may optionally be provided to the ECM 20 to monitor a state of charge, as illustrated by a broken line. The DC power supply may at least partially receive power from an internal battery 35.

The ECM 20 may also include components to energize motors using a backup power source, such as a battery 34. For example, the ECM 20 may include an AC power output component 116. The AC power output component 116 may be used to energize a DC battery 34, for example, by using a battery charger 32. Alternatively, the AC power output component may be used to drive one or more AC motors of the primary and/or backup pumps.

The ECM 20 may be used to operate and/or test one or more primary pump. For example, the ECM 20 may be used to operate two primary pumps, a first primary pump 50 and a second primary pump 51. The ECM may also be used to operate and/or test one or more backup pump. The backup pump may be a DC backup pump 112, AC backup pump 114, or a combination of AC and DC backup pumps. In an embodiment wherein the backup pump is a DC backup pump 112, the ECM 20 may direct power to the DC backup pump 112 from a battery 34. In an embodiment wherein the backup pump is an AC backup pump 114, the ECM 20 may direct power from one or more battery 34 through an inverter 36, which may convert the DC power from the battery into AC power that is usable by the AC backup pump 114. Feedback from the battery 34, such as a voltage feedback, may optionally be provided to the ECM 20 to monitor a state of charge, as illustrated by a broken line. Additionally, the ECM 20 may control the AC backup pump 114 to be at least partially powered by the AC power source connected to the AC power component 36.

The battery 34 may be configured to deliver sufficient power to the system in the event of a failure to receive AC power from the power source. One or more battery 34 may be included by the system to provide sufficient voltage and current to drive the ECM 34, backup pump motor 112, 114, and/or additional components of the system. For example, the battery 34 may be configured in 12 v or 24 v arrays of one or more battery 34. Skilled artisans will appreciate additional arrays of batteries providing voltages of 2, 4, 5, 6, 9, 10, 11, 13, 14, 15, 18, 21, 22, 23, 25, 26, 27, 30, 36, 48, 60, 72, 84, 96, 108, 120, 180, 240, or other voltages. The battery 34 may be included with additional components to facilitate the conversion electrical energy stored in the battery 34 to electrical power usable by the other components of the system. The additional components associated with the battery 34 may include a charger 32 to supply and maintain a charge in the battery 34 and/or an inverter 36 to convert the electrical power delivered by the battery 34 from DC to AC.

The ECM 20 may also include a sensor control component 102. The sensor control component 102 may receive a signal from one or more sensors. In one example, the sensors may include water level sensors, which may be float switches located in a sump, which may be activated when a water level reaches a configurable level. In the present example, the water level sensors may include a primary float sensor 46 and a backup float sensor 48. The primary float sensor may determine a first threshold level of a liquid (for example, high water level), wherein activation of the primary float sensor 46 may cause the ECM 20 to operate the primary pump 50, 51. The primary pump 50, 51 may be controlled by the primary motor control 104 of the ECM 20. Similarly, the backup float sensor 48 may determine a second threshold level of a liquid (for example, very high water level), wherein activation of the backup float sensor 48 may cause the ECM 20 to operate the backup pump 112, 114. The backup pump may be controlled by the backup motor control 110 of the ECM 20.

The ECM 20 may include a communication component 170, which may be used to communicate with additional electronic devices, such as the system monitor. The communication component 170 may detect conditions in the system and generate communication indicative of the status of the ECM 20 and/or pump components. The communication may be transmitted to the system monitor as a signal over a network 60. The communication component 170 may connect to a bi-directional network controller 26. The network connection may include a wired, wireless, or combination of wired and wireless connections. For example, sensors and other components of the system may connect to the ECM 20 via a wired connection.

The network controller 26 may establish a connection to the network 60 via an intermediary device, such as a router and/or modem 174. If a modem 174 is used, the modem 174 may communicate with connected devices through an Internet service provider (ISP) 176 over a network 60, as provided by the Internet. The ECM 20 may connect wirelessly to a wireless network router, which may communicate with the system monitor over the Internet via the modem 174. The communication may create a virtual network over the Internet, facilitating the communication between the ECM 20 and the system monitor.

The ECM 20 may additionally include an I/O interface 28. The ECM 20 may communicate and/or interact with additional components via the I/O interface 28. Additional components may include pump components, a display 112, keypad 124, alarm 126, and other devices connectable to the ECM 20.

Communication between the ECM and a network will now be discussed in greater detail. More particularly, activation and deactivation of a local installation will now be discussed. The ECM and pump components may be installed in the home of a user as a local installation. The local installation may include connecting the pump components and/or sensors to the ECM. The local installation may additionally include connection of the ECM to a network, for example, provided by a router, and activation of the communications by the ECM through the network.

For example, an ECM may be configured to operate over a wireless network by locating the network, configuring the network password into the ECM, and authenticating the ECM on the network. After being activated, the ECM may receive communications from the system monitor. The ECM may then operate in automatic mode, to control and test the system without polling from the system monitor, or the wait-for-request, which will be described in greater detail below. Conversely, the ECM may be configured to remove a network and/or deactivate communications over a network by removing a broadcasted network name and/or password from the memory of the ECM.

Communication and message control between the ECM and the system monitor will now be discussed. The ECM may communicate bi-directionally with the system monitor over a network, such as the internet, to control and test the pump components of the system. Communication between the ECM and the system monitor may include receiving an operate command by the ECM from the system monitor to operate the pump components. A condition of the pump components may be measured during a test, which will be discussed in greater detail below. Additionally, communication may include receiving a report command by the ECM from the system monitor to report a status. Communication may further include transmitting a status from the ECM to the system monitor. If a test determines that a pump component is operating within an acceptable operational range, the ECM may communicate a signal to the system monitor indicating that the pump component is operating in compliance with the system specification. Conversely, if a test determines that a pump component is operating outside of an acceptable operational range, the ECM may communicate an error to the system monitor. A communication indicating an error may include the error, an error code relating to the error, a time at which the error was detected, a component causing the error, and/or other information to assist the system monitor to analyze the error.

In the interest of clarity, examples of messages communicable between the ECM and the system monitor will now be discussed without limitation. The ECM may communicate a signal indicating compliance with an expected operation, which may include a system advisement. These type of system advisement messages are generally used to advise the system monitor that a normal system function has occurred or exists. These functions include the normal activation of the float level switches, determination that float switches are connected, AC power is present, external battery is charged, pump motors start and run, high water level has been experienced, very high water level has been experienced, generally a "System OK" message, and/or another message indicative of acceptable operation of the system. Conversely, the ECM may communicate a signal indicating an error has occurred, such as a service request. These error messages are generally used to issue a request for maintenance when a system component or function fails.

Tests that may produce an error include determining a value of AC 1 power in and/or AC 2 power in; operational status of a first primary pump, a second primary pump, and/or a backup pump; operational duration of the first primary pump, second primary pump, and/or backup pump;

connection and status of sensors, such as float switches to detect high water levels and/or very high water levels; correlation of sensor readings and pump operation, for example, primary float SW 1 is ON but primary pump is OFF or backup float SW 2 is ON but backup pump is OFF; and/or connection, state of charge, and health of batteries and associated charging components. Illustrative messages that may be generated by a system monitor may include an information request, system description, primary pump designation, backup pump designation (DC, AC), external battery designation (12 volt, etc.), inverter designation, connection of AC 1 power in, connection of AC 2 power in, sensor designation (float SW 1, float SW 2, etc.), external battery installation date, and/or time of day of message transmission (hr/min/sec) Illustrative messages may additionally include messages relating to system status, such as value of AC 1 power in, value of AC 2 power in, operation status and/or duration of primary pump, operation status and/or duration of backup pump, connection and/or value detected by sensor (float SW 1, float SW 2, etc.), external battery voltage, external battery state of charge, and/or inverter values. The system monitor may detect and produce messages regarding the status of the ECM state of health, such as ECM OK or ECM not OK.

In the event of a failure of 120 VAC power to a installation location, the router may lose power also and not be capable of bi-directional communication with the ECM, even though the ECM itself may include an internal battery to maintain communications for a time, if the ECM should lose AC power. However, users may support their Internet connection (modem, router, and other communication equipment) with a battery backup system, such as with an uninterruptible power supply (UPS), would still be able to support ECM bi-directional communication with the system monitor server. In those instances, a support company could come to the installation location with a portable AC power source, such as a generator, to supply emergency power for the pump components and system. Also, some users may have automatically and/or manually operated AC power generators at their installation locations. Such backup provisions may be financially justified for customers who have substantial risk of loss if their basements flood or commercial customers whose operations would be severely damaged due to flooding due to loss of sump pump support. Even the psychological impact of a flooded basement is sufficient justification for some to provide generator backup.

The system monitor may communicate an action request to the ECM. The action request may command the ECM to operate the system in a particular manner, for example, to perform a test. An action request may include a command to turn on a primary pump for a duration, turn off the primary pump, turn on a backup pump for a duration, turn off the backup pump, test a sensor, measure power from the power source over one or more circuits, send ECM data (serial no, Julian date code of manufacture, installation date, name of installer), and/or send test message to ensure that communication link is totally operational.

Activation and/or deactivation of monitoring services will now be discussed. When a user contracts to pay for monitoring provided by the system, the service may be activated by an installer at the customer site, for example via the keypad or remotely from the system monitor. The monitoring service may be provided as a subscription to monitor and response to conditions detected by the ECM and/or system monitor.

Automatic mode will now be discussed in greater detail. In the automatic mode, the ECM may monitor system status, execute pump component tests, and report results back to the system monitor for further analysis. The tests may be performed in a scheduled, periodic, occasional, or substantially random basis. Results of the tests indicating that the pump components are operating within an acceptable operational range may cause the ECM to transmit a signal to the system monitor indicating compliance, such as a "System OK" signal. Conversely, results of the test indicating that the pump components are operating outside of an acceptable operational range may cause the ECM to transmit a signal to the system monitor indicating an error, such as a "maintenance request" signal and optionally a corresponding error code.

The ECM may automatically issue a signal to the system monitor indicating a status of the system, for example, a state of health message. The signals may be periodic or otherwise timed. The system health signal may provide the system monitor with status or health of the system without waiting for a request from the system monitor. Skilled artisans will appreciate other message types may be communicated between the ECM and the system monitor.

The wait-for-request (WFR) mode will now be discussed in greater detail. In the WFR mode, the ECM may continue to monitor and test the pump components prior to receiving a request from the system monitor. The results of the continual testing and monitoring may be store in memory of the ECM. The results may be communicated to the system monitor upon request.

When a request of status is received from the system monitor, the ECM may respond to the request by first, upon receiving a request for status message monitor, responding with information as to the status of system component and the operational status of the pump components. As a result of the test, the ECM may respond with a compliance indicating "System OK" Message or with an error indicating "Maintenance Request" message.

Alternatively, upon receipt of a request of status from the system monitor, the ECM may perform testing operations on the pump components. Testing operations may include testing pump motors, turning on pumps for a preset or variable amount of time, testing for AC power availability, testing for integrity of the sensors, such as float switches, and testing of other components. Initiating tests in WFR mode advantageously enables full control of the pump components through the remote system manager via the ECM.

Additionally, upon receipt of a software update message, the ECM may download an updated operation code to its memory. The ECM may additionally update its operational software upon instruction from the system monitor, manual instruction, or other instruction. Manual instruction may include instruction provided via a keypad or other interface device.

The ECM may automatically issue a periodic or otherwise timed state-of-health message to the system monitor to ensure that it is operational, without waiting for a request from the system monitor. Skilled artisans will appreciate additional message types that may be communicated between the ECM and system monitor to control operation of the system. Skilled artisans will additionally appreciate numerous message types communicable via the system after having the benefit of this disclosure.

Determining a condition via a sensor will now be discussed. More particularly, as an example, water level detection will now be discussed. Water level may be detected by a sensor, such as a float switch assembly, which may include a housing with one float switch, a pair of electrically independent float operated switches, or another number of float switches and/or other sensors. Alternately, the float switch assembly may include two separate switch assemblies with a shared harness and connector. The float switches may control the primary and backup pump system.

The sensor may include a primary float switch SW 1, which may be used to activate the primary pump (AC Motor & Pump-1). The switch may normally be open when the water is at a normal level and closes when a high water level is established. The threshold by which the primary float switch may be activated can be determined by the placement of the switch during installation in a sump pit.

The switch may include an electrical resistor in parallel with the switch so that it may be queried by the ECM in order to determine whether the switch is connected to the ECM. Circuitry in the ECM may be provided to test the continuity of the connection to determine whether the switch assembly is connected to the ECM. When a second primary pump is used (AC Motor & Pump-2), it may be turned on and off concurrent with the first primary (AC Motor & Pump-1).

The sensor may also include a backup float switch SW 2, which may be used to activate the backup pump. The switch for the backup pump may normally be open when the water is below a very high level and closes as a very high level is established. The very high level may be higher than the level sufficient to close the primary float switch.

The backup float switch advantageously adds redundancy to the system, decreasing the likelihood of a failure by the system. For example, if main AC power is lost, the primary pumps may fail to function. A rising water level will then be detected by the backup float SW 2 activating. When the circuit of the backup float SW 2 closes, it may activate the backup pump. Additionally, the system may be configured such that when the backup float SW 2 closes, it activates both the primary pumps and the backup pumps. The pumps may be activated via the ECM. The switch may include an electrical resistor in parallel with the switch so that it may be queried by the ECM in order to determine whether the switch is connected to the ECM. Circuitry in the ECM may be provided to test the continuity of the connection to determine whether the switch assembly is connected to the ECM.

Activation levels will now be discussed. The primary switch SW 1 may activate (close) when a rising liquid level reaches a respective mark on the switch. Similarly, the primary switch SW 1 may deactivate when a falling liquid level drops below the activation level. The backup switch SW 2 may activate and deactivate similarly as the primary switch SW 1, described above. However, in some configurations, the activation level may be higher for the backup switch SW 2 than the deactivation level, which may correspond with the deactivation level of the primary switch SW 1. The switch assembly may operatively connect to the ECM, for example, via a cable.

Electrical operation of the float switches will now be discussed. The float switches may be configured with an electrical rating for each float switch that would be appreciated by a person of skill in the art. The electrical rating may include a maximum current capacity, maximum applied voltage across the switch terminals, resistance rating of the electrical resistor configured in parallel with the switch in order to facilitate determination as to whether the switch is connected to the ECM, contact resistance of each switch, and minimum open-close cycles operable by the switch without deterioration.

The system may receive electrical power from a power source. The power source may be supplied by a household power grid, which transmits power as alternating current. Electrical power from the power source may be received from by the system and delivered to the pump components by the ECM.

In an embodiment of the invention, the power source may include two or more separate, dedicated 120 volt AC input circuits. In the interest of clarity, and example with two power circuits, as first primary circuit and a second primary circuit, will be discussed throughout this disclosure, without limitation. Each input circuit may be supplied from a separate breaker in the main maintenance panel of the household electrical grid. For ease of reference, the AC input circuits are designated AC 1 power in for the first primary circuit and AC 2 power in for the second primary circuit. The breakers associated with each power circuit may have substantially similar current ratings, for example, 15 amperes. Skilled artisans will appreciate additional embodiments with current rating of 1, 2, 3, 4, 5, 6, 7, 8, 9, 10, 11, 12, 13, 14, 16, 17, 18, 19, 20, 25, 30, 35, 40, 45, 50, or another current rating in amperes.

The system may optionally be configured with only one AC primary power circuit, referenced above as the first primary circuit AC 1. When only AC 1 is present, it may be used to power all ECM and motor functions, including driving primary pumps and backup pumps. Operation of the system with only one power circuit will be described in greater detail below. The breaker of the single power circuit may have a rating of sufficient amperes to drive the ECM and pump components of the system, as will be appreciated by a person of skill in the art.

As discussed above, the system may be configured with a primary power source having two or more AC primary circuits. For example, with two primary power circuits, a second primary circuit AC 2 may accompany AC 1. Where two power circuits are present, one or more of the power circuits may be used to power all external modules used for backup pump and associated components.

If AC 2 is not present, the system may switch to AC 1 for its input power for both primary and backup pumps and associated components. If AC 2 was initially present and subsequently goes offline, the ECM may detect an error. The error may be reported by the ECM to the system monitor, which may initiate a maintenance request message.

The ECM may operate on power from the power source, which may be converted from AC to DC. The ECM can also operate on an internal and/or external battery. When neither AC 1 nor AC 2 is present, the ECM may switch to its internal battery for all ECM functions. While operating from the internal battery, the ECM may enter a standby mode to conserve internal battery consumption. For example, in standby mode, the ECM may disable the display lighting, such as by only providing the lighting when readout is selected manually from the keypad on the ECM. The display lighting may persist for a brief interval to conserve the internal battery. The ECM may then return to standby mode after the display interval has expired. Additionally, to conserve power, the ECM may handle messages and communications from the system monitor with increased efficiency. For example, when a message is received from the system monitor, the ECM may energize using the battery to receive and process the request and then return to standby mode.

When neither AC 1 nor AC 2 is detected, the ECM may switch to a default control mode to enable the backup pump systems to function in the event of a very high water level condition. In the absence of AC power, and lacking substantial internal battery capacity for control functions, relays may be utilized to default to the control modes described in the following. Although the external battery may be available, additional drain on its capacity will likely shorten the pump time capacity of the backup system.

As discussed above, the system may include an inverter to convert power stored by one or more batteries into AC power that can drive a motor. However, while the AC power, for example, 120 VAC, may be available when the inverter system is present, use of the battery for the ECM to control functions may deplete the battery pack and reduce the backup pump time capacity. If only momentary use of either the battery and/or the inverter is required to enable functional control from a sensor, such as the backup float switch, to the appropriate backup pump motor, the ECM may be energized to enable such configuration and subsequently placed back in standby mode.

In one embodiment, the system may include a battery to power a DC backup motor. For example, without limitation, a backup pump may be driven using a 12 volt DC motor. When the 12 volt backup system is installed, a sensor, such as a backup float SW 2, may switch the 12 volt battery power to directly supply the 12 VDC motor with electrical power when a high water level exists. Control of these functions could be accomplished using the charger, for example, a 12 VDC trickle charger unit, which may be designed for providing power but being bypassed in order to efficiently draw power from the battery.

In another embodiment, the system may include a battery to power an AC backup motor. For example, without limitation, a backup pump may be driven using a 120 volt AC motor. The system may supply 120 VAC from the battery using an inverter. For example, the battery may provide 24 VDC, which may be drawn from two batteries configured in an array. The inverter may invert the 24 VDC input to the 120 VAC output from the inverter to power the 120 VAC motor when a threshold water level exists.

The power source may additionally be used to drive various components of the system. For example, AC power may be utilized to power the ECM, utilized to otherwise charge the external battery, power the primary AC pump motor, and/or provide power to the battery charger, which may be controlled via a receptacle on the ECM. The AC power source may also be converted to DC power prior to being used by the system. For example, the power source may be used to power the DC to AC inverter, if available, provide power to the internal ECM DC power supply, provide an internal regulated source of DC power, and/or provide DC power to the ECM circuitry when AC power in is present.

The internal battery may keep the ECM operational for a sufficient amount of time after loss of power from the AC power source. As discussed above, reduced functionality may be implemented to prolong operation of the ECM from the internal battery, with the ECM potentially defaulting to standby mode. Alternatively, in lieu of an internal battery, the ECM may operate using power supplied by a connected battery, such as the battery used to drive one or more motor. The ECM may also operate using power from the AC output from the inverter, which may be converted to DC power by the ECM.

The internal battery will now be discussed in greater detail. The internal battery may be used to provide DC power to the ECM when the AC power source is disconnected and/or not energized. The internal battery may direct electrical power to drive an internal ECM DC power supply. As discussed above, the ECM may default to standby mode to conserve power when operating from the internal battery. The internal battery may also be used to provide a temporary source of VDC to other components of the system.

The ECM may detect and monitor a charge level of the internal battery. For example, the ECM may be configured to ensure the internal battery has a sufficient remaining capacity to operate the ECM in the event of a failure for a definable duration. Additionally, the ECM may determine a time elapsed since the last replacement of the internal battery. If it is determined by the ECM that the internal battery does not have sufficient charge, or that the time since the internal battery has been replace exceeds a threshold duration, the ECM may communicate an error to the system monitor indicating the status of the internal battery. The system monitor may then analyze the error and determine whether to initiate a maintenance request to replace the battery. Additionally, the system monitor may command the ECM to operate with reduced functionality until the maintenance request has been fulfilled and/or another condition occurs. The internal battery may be maintainable via a separate compartment or access from the other components of the ECM, allowing replacement without having to open the ECM box itself.

Testing and control of motors used to drive a primary pump will now be discussed. The motor used to drive a primary pump may operate using alternating current. During testing, the ECM may sense whether an AC motor is connected to the ECM. If no motor is detected, the ECM may communicate an error signal to the system monitor. The system monitor may then analyze the error signal and, upon determination that maintenance is required, issue a maintenance request. If the ECM determines that an AC motor is connected and operating properly, the ECM may communicate a compliance signal to the remote system. In one embodiment, the ECM may include a switch, such as a slide switch, to inform the ECM which motors are connected. During testing, the ECM may confirm the settings indicated by the switch.

The ECM may test a connected motor periodically and/or according to a duration to determine if the motor is functioning properly. The test may include: 1) powering an AC motor for a duration; 2) measuring whether a starting current is within an acceptable range for a period after the AC motor initially receives power; and 3) measuring whether a running current is within an acceptable range for a duration after the starting period has elapsed. If the functional test fails, the ECM may communicate an error signal to the system monitor. The system monitor may then analyze the error signal and, upon determination that maintenance is required, issue a maintenance request. If the functional test passes, the ECM may communicate a signal to the system monitor indicative of compliance. The results of previous tests may be stored in memory. The previous results may be remembered and can be verified at a later time.

An example of an error signal communicable by the system may include an indication of a motor failure. For example, if a motor draws "start current" continuously (more than a portion of a second, typically), the ECM may determine that either a bad motor condition has occurred and/or the motor may have become mechanically stalled. Stalling may occur to an otherwise operational motor, for example, if the impeller blades become blocked by debris or any foreign material. Stalling may occur in a bad motor, for example, due to a broken impeller blade. Diagnostics relating to the failure may be provided in a maintenance request for repair.

Skilled artisans will appreciate that different makes and models of motors may be connected to the system, each of which with particular current values. The system may detect and/or be programmed to consider such current values during the test of each type of motor. A certification process may be included by the system of the present invention to include a table of current values for each type of approved motor. Current values for approved motors may be detected by the system automatically and/or programmed manually. Current values for motors that are not approved may be inputted into the ECM memory when the system is installed and/or when a motor is repaired or replaced.

Skilled artisans will additionally appreciate that a condition of a motor may be determined with using various other tests and sensors. For example, an RPM sensor, or tachometer connected to a shaft of the motor, could be employed to determine whether the motor is turning when commanded to operate. The invention is not intended to be limited to the start/run current method of testing for motor integrity.

The ECM may respond to the switch test and control circuit and enable one or more AC primary motor when sensor SW 1 is activated by high water level. If two primary pumps are included by the system, the first primary pump and the second primary pump may be started substantially simultaneously. For the purpose of this disclosure, substantially simultaneously is intended to include starting within between exactly at the same time and having a short delay between starting times to reduce current load on a connected power source. For example, without limitation, the second primary motor may be started with a short delay of between one and five seconds so that the supply line circuit breaker does not open due to high starting current from two motors instead of one. The above example is intended to be included by the term substantially simultaneously.

The ECM may record a date and time that one or more pump is activated. A number of past operations of the pump components may be stored in memory. The data stored in the memory may be transmitted to the system monitor for further analysis and determining analytics.

Testing and control of a backup pump motor will now be discussed. The ECM may determine which type of backup pump motor is included by the system. For example, the ECM may determine whether the backup pump operates using a DC or AC motor.

A backup pump that uses a DC motor will now be discussed. For a DC motor, the ECM may determine which type of DC motor is connected if several are available. For example, the ECM may identify a make and model of a DC motor attached to the system. In illustrative DC motor that may be connected to the system and detected by the ECM may include a typical DC2011 motor.

The ECM may test a connected backup motor periodically and/or according to another duration to determine if the motor is functioning properly. The test may include: 1) powering a DC motor for a duration; 2) measuring whether a starting current is within an acceptable range for a period after the DC motor initially receives power; and 3) measuring whether a running current is within an acceptable range for a duration after the starting period has elapsed. If the functional test fails, the ECM may communicate an error signal to the system monitor. The system monitor may then analyze the error signal and, upon determination that maintenance is required, issue a maintenance request. If the functional test passes, the ECM may communicate a signal to the system monitor indicative of compliance. The results of previous tests may be stored in memory. The previous results may be remembered and can be verified at a later time.

Skilled artisans will appreciate that different makes and models of DC motors may be connected to the system, each of which with particular current values. The system may detect and/or be programmed to consider such current values during the test of each type of motor. A certification process may be included by the system of the present invention to provide a table of current values for each type of approved DC motor. Current values for approved DC motors may be detected by the system automatically and/or programmed manually. Current values for DC motors that are not approved may be inputted into the ECM memory when the system is installed and/or when a motor is repaired or replaced.

The ECM may control the backup pump motor in normal operation. For example, the ECM may engage the backup pump motor when sensor SW 2 is activated by a very high water level. The ECM may record a date and time whenever the backup pump is activated for the last number of occurrences. If sensor SW 2 activates but DC motor current is not detected, an error or system failure may be detected. The ECM may communicate an error signal to the system monitor. The system monitor may then analyze the error signal and, upon determination that maintenance is required, issue a maintenance request.

A backup pump that uses an AC motor will now be discussed. For an AC motor, the ECM may determine which type of AC motor is connected if several are available. For example, the ECM may automatically identify a make and model of an AC motor attached to the system. Alternatively, during installation, an installer may input the information regarding the AC motor for the backup pump into the ECM, for example, via the keypad.

A backup pump driven by an AC motor may be connected to a power supply. For example, the AC motor of the backup pump may be connected to the primary power source and/or the backup power source. If the AC motor of the backup pump is connected to the primary power source, it may be connected to the first primary circuit, second primary circuit, or other circuit of the primary power supply. Additionally, the AC motor of the backup pump may be connected to a backup power source, which may be supplied by the inverter. The inverter may automatically use a power source connected to the household grid if the load required is greater than a threshold load, for example, 90 VAC. The inverter may additionally use and/or invert DC power if AC power is not available from the household grid. The backup power may be provided by a battery and/or array of batteries, such as an array of two batteries to provide 24 VDC to the inverter. The voltage may be fed to the motor terminals from the output of the inverter. The motor output from the inverter may be directed to the ECM, which may switch this output onto the AC motor under normal operational conditions.

A sensor may be used to help control operation of the backup pump. This sensor may include the backup float SW 2 switch, which may provide a signal sent to the inverter from the ECM whenever a high water condition exists. The inverter may then provide power to the motor. The ECM may temporarily disconnect the inverter so that the motor may be driven directly from the ECM to test for functionality of the motor.

The ECM may provide a periodic test of the AC motor to determine whether the AC motor is functional. If the sensor, which may include a float switch, detects a high water level and the pump motor is activated by the ECM, the test may be deferred until the pump motor is turned off. However, if a message is received from the system monitor to test the motor, the test message may override the current pump status and allow the test to be performed. Testing of the AC motor of the backup pump may be performed similarly to the testing of primary AC motors, as described above.

The battery charger backup system will now be discussed. The battery may be connected to a charger, which may be used to provide and maintain a charge in the battery. The battery charger may provide DC current to trickle charge the battery. The battery used with DC motors may be, for example, a 12 volt lead-acid battery. As another example, the battery may be a 12 volt deep-charge lead-acid battery, without limitation. The battery used with AC motors may be, for example, a 24 volt array of batteries. However, those of skill in the art will appreciate additional batteries that may be used with the system after having the benefit of this disclosure. Additionally, skilled artisans will appreciate the operation of battery trickle chargers. Batteries used to power the DC motor and the AC motor may differ.

If the ECM detects that a battery is not connected, the ECM may check to determine whether the inverter is being used instead. This check can be done by determining whether an AC motor is connected at the terminals provided by the ECM is in operation. If no battery is detected and an AC motor is not being operated from the inverter, the ECM may communicate an error signal to the system monitor. The system monitor may then analyze the error signal and, upon determination that maintenance is required, issue a maintenance request.

Additionally, the ECM may test the battery to determine whether the battery voltage is within an acceptable operable range. If the battery voltage level test fails, the ECM may communicate an error signal to the system monitor. The system monitor may then analyze the error signal and, upon determination that maintenance is required, issue a maintenance request. Although the external battery charger may provide indicators for various conditions, the status of these conditions may be ascertained by the ECM for the purpose of transmitting the information to the system monitor.

The inverter and associated backup power system will now be discussed. The inverter may convert DC power from a battery or array of batteries to AC power, which may be used by AC motors. The inverter may be tested by the ECM by disconnected the power source from the inverter. The ECM may then simulate a closed sensor or switch inside the ECM, causing the inverter to turn on and provide power to the AC backup motor. Power may be derived by the inverter from a 24 volt battery pack, since the primary power source has been temporarily disconnected by the ECM. If the ECM detects that an AC motor is receiving a sufficient voltage to drive the AC motor, the system may determine that the inverter is operating in a state of compliance. The ECM may communicate a signal to the system monitor indicating that the inverter is operating within compliance of the expected operational range. Conversely, if it is determined by the ECM that the AC motor connected to the inverter is operating outside of an acceptable operational range, the ECM may determine that an error has occurred. The ECM may communicate an error signal to the system monitor. The system monitor may then analyze the error signal and, upon determination that maintenance is required, issue a maintenance request.

As discussed above, the system may include an external 12 volt lead-acid battery. Alternatively, the system may include an array of 12 volt lead-acid batteries. Discussion of a 12 volt lead-acid battery is provided in the interest of clearly describing an embodiment of the invention, and is not intended to limit the type or types of batteries usable with the system of the present invention in any way Skilled artisans will appreciate alternative batteries usable by the system after having the benefit of this disclosure.

An illustrative lead-acid battery may provide a nominal 12 VDC power source for the DC backup motor or a nominal 24 VDC power source for the inverter used for the AC backup motor. The lead-acid battery may also provide power for the ECM circuitry if the AC power source fails. The lead-acid battery, or other battery used by the system, may provide power to the ECM in substitution or addition to the internal battery.

The battery may be configured to indicate a failure if it is discharged. The battery may be tested by the ECM to determine whether it carries a charge. The ECM may measure the state of charge (SoC) of the external battery used to power the backup DC motor. Due to difficulty determining whether an open or no load connection from the batteries to the ECM exists, the ECM may include additional circuitry to further facilitate testing of the battery. The test of the battery may test a correlation between a no load terminal voltage of lead-acid storage batteries and the percentage of charge (state of charge) remaining in the battery. To make the measurement, all loads may be removed from the battery prior to measuring. If the SoC charge test determines that the battery is operating outside of an acceptable operational range, the ECM may communicate an error signal to the system monitor. The system monitor may then analyze the error signal and, upon determination that maintenance is required, issue a maintenance request.

The ECM may provide an alarm to the user upon the occurrence of an event and/or detection of a condition. The alarm may be overridden via interaction with the ECM by a user, for example, via the keypad. Alarms may be configured manually by a user or an installation technician. Additionally, alarms may be configured via a command from the system monitor.

The display may provide a visual indication of an alarm. The display may provide a read out of system parameters indicating inputs, installation date, external battery, open circuit voltage, state of charge of a battery, and other information. The system may also include components to provide an audible alarm. The audible alarm may provide various distinguishable sound patterns to provide warning to a user when certain conditions are detected. Conditions that may engage an audible alarm may include errors detected by the system. A bypass may be provided to turn off the alarm manually. Additionally, the system may be configured to disengage the audible alarms after a configurable duration has elapsed. Disengagement of an audible alarm may advantageously preserve the internal battery in the event of AC power loss.

The system may include a display to provide feedback regarding operation of the system. The display may include a screen, LCD panel, LED indicators, and/or other sources of visual feedback. The LED indicators may indicate a status of the system. LED indicators may include AC 1 power—on/off, AC 2 power—on/off, external battery charged, primary pump connected, backup DC pump connected, float SW 1 disconnected, float SW 2 disconnected, internal battery voltage low, replace internal battery with (type), primary pump not operational, backup pump not operational, and other indicators. The indicators may be configured to turn off manually via the keypad and/or after a duration has elapsed. Manual disengagement of the indicators may be accessible to the user.

The system may include a number of input and output connections. For example, the system may include manual pump switches, or inputs manipulable by a user to manually operate one or more pump, motor, and/or pump components connected to the system. Separate toggle switches may be provided on the ECM so that both the primary and secondary pumps may be switched on manually. Manual switching of the components may override the controls programmed and/or issued by the ECM electronic controls. Manual switching of the components of the system advantageously allows pump operation even if the float switches or ECM should fail as an emergency action.

The system may include additional input and/or output relating to the power source, including AC 1 power in, AC 2 power in, AC 1 power out, AC 2 power out, inverter motor in, inverter motor out, and/or external battery in. The AC power out connections may be used in connection with the battery charger and/or inverter. The system may additionally include input and/or output relating to sensors, including primary float SW 1 in, backup float SW 2 in, primary float SW 1 out, and/or backup float SW 2 out. The sensor output connections may be used in connection with the battery charger and/or inverter.

The system may include additional input and/or output relating to the pump components, including primary pump out, backup primary pump out, AC motor pump out, and/or DC motor pump out. Additionally, the system may include communication input and/or output relating to the networking components, include network I/O, Internet cable feed, Internet router antenna, telephony, and/or other communication connections.

The ECM may include one or more fuse to protect internal circuitry from external shorts and overloads. The ECM may also be designed to be physically and/or operationally upgradeable, for example, including an output control line to a home security system. The home security system may operate at least partially over a telephone connection and may provide redundancy in case another connection to the network is lost. The ECM design may also comprehend possible future enhancement to include communication output to a cell phone, advantageously adding additional redundancy to the system. The ECM may include manufacturer's part number, Julian date code of manufacturer, serial number and/or other identifying information. The serial number may be used as identification during the transmission of messages between the ECM and the system monitor. Alternatively, an electronic address, such as a MAC address of the ECM, may be used to as identification of messages.

In an additional embodiment, auxiliary components may be connected to the system. Auxiliary components may include heating systems, air conditioners, lights, dehumidifiers, refrigerators, freezers, appliances, and other devices. The auxiliary components may be controlled, monitored, or otherwise operated by the system. The ECM may be configured with parameters to test conditions of the connected auxiliary components and detect errors in operation of the same. Status of the connected auxiliary components may be communicated to the system monitor, where the status may be associated with a profile for the installation location.

In operation, the system of the present invention may be used to monitor, test, and control pump components. As discussed above, pump components may include one or more primary pump, one or more backup pump, primary power source, backup power source, sensors, batteries, a charger, an inverter, and other components. The system may include an ECM that communicates with a system monitor over a network. The ECM may also receive a status communication from a sensor and control various pump components.

The following illustrative operations are provided in the interest of clearly describing an embodiment of the present invention. Skilled artisans will appreciate that additional operations may be performed that would accomplish essentially the same purpose of the invention after having the benefit of this disclosure. Therefore, those of skill in the art should not view the present invention to be limited by the following illustrative operations in any way.

An illustrative method to operate a system for testing pump components will now be described. The method may be performed on a system including an electronic controller module (ECM) that is bi-directionally communicable with a system monitor via a network. The method may include establishing a communication over the network between the ECM and the system monitor, the network being communicable over the Internet. The communication may be established via a router, which may wirelessly connect to the ECM. The method may also include monitoring a sensor communicably connected to the ECM to determine a condition of the pump components. The ECM may monitor the sensor periodically and/or in response to a command from the system monitor. The method may further include testing the pump components. Testing may be initiated by a command from the system monitor or the ECM.

If the testing is initiated by the system monitor, the testing may include (i) receiving an operate command by the ECM from the system monitor to operate the pump components, the condition of the pump components being measurable during a test that operates the pump components; (ii) receiving a report command by the ECM from the system monitor to report a status; and (iii) transmitting the status by the ECM to the system monitor, wherein if the test determines the condition is within an acceptable operational range, the ECM communicates a signal indicative of compliance to the system monitor, and wherein if the test determines the condition is not within the acceptable operational range, the ECM communicates a signal indicative of an error to the system monitor.

Additionally, the method may include processing the status using the system monitor. Processing the status may further include (i) monitoring for the signal provided by the ECM, (ii) analyzing the status reported by the ECM, (iii) if the status includes the error, determining whether to initiate a maintenance request in response to the error and initiating the maintenance request when determined to be necessary, and (iv) if the status includes the error, determining whether to report the error to a user and reporting the error when determined to be necessary. The pump components may be manually controllable to override control by the ECM.

The system monitor may include database operatively connected via the network. A profile may be stored in the database. The profile may include information relating to the ECM and the pump components operated at an installation location, historical data for determining analytics, and billing information. The profile is maintainable by the system monitor to monitor the ECM and report feedback to a user requiring a subscription for monetization. The ECM may be updatable by the system monitor via the network.

Communication between the ECM and the system monitor may additionally include (i) communicating by the ECM with a router via a local area network, and (ii) directing the communication between the ECM and the system monitor via the Internet using the router.

Figure 3:
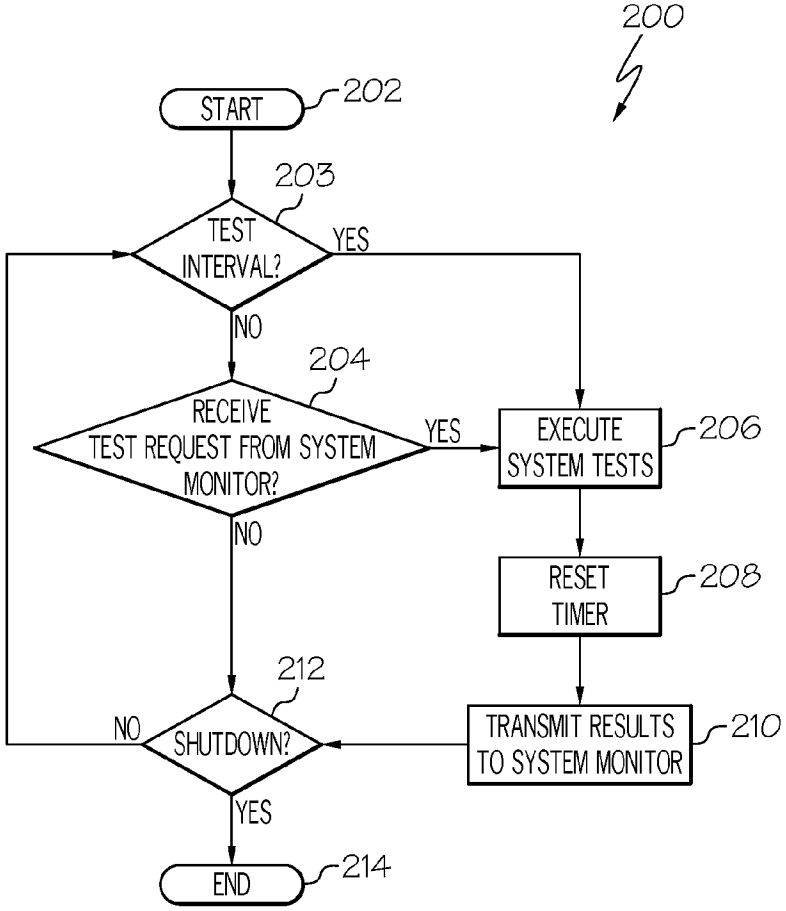
FIG. 3 is a flowchart illustrating initiation of a testing operation, according to an embodiment of the present invention.

Referring to flowchart 200 of FIG. 3, an illustrative testing operation will now be discussed. Starting at Block 202, the system may determine if a test interval has occurred. (Block 203). A test interval may occur upon elapse of a duration between tests. The duration may be periodic, asynchronous, predefined, dynamically determined, or otherwise set. If no test interval has occurred, the system may determine whether a test request has been received from the system monitor. (Block 204). If it is determined at Block 203 that a test interval has occurred or at Block 204 that a test request has been received by the system monitor, the operation may begin to execute system tests. (Block 206). The operation may then reset a timer that determines the interval. (Block 208). Next, the results of the test may be transmitted to the system monitor. (Block 210). The results may include a signal indicative of compliance and/or an error. After the results have been transmitted at Block 210 or it is determined that no test request is received at Block 204, it may be determined whether it should shutdown. (Block 212). If it is determined at Block 212 that the system should not shut down, it may return to the operation of Block 203, where it will again determine if a test interval has occurred. If it is determined at Block 212 that the operation should shutdown, the operation may terminate at Block 214.

Figure 4:
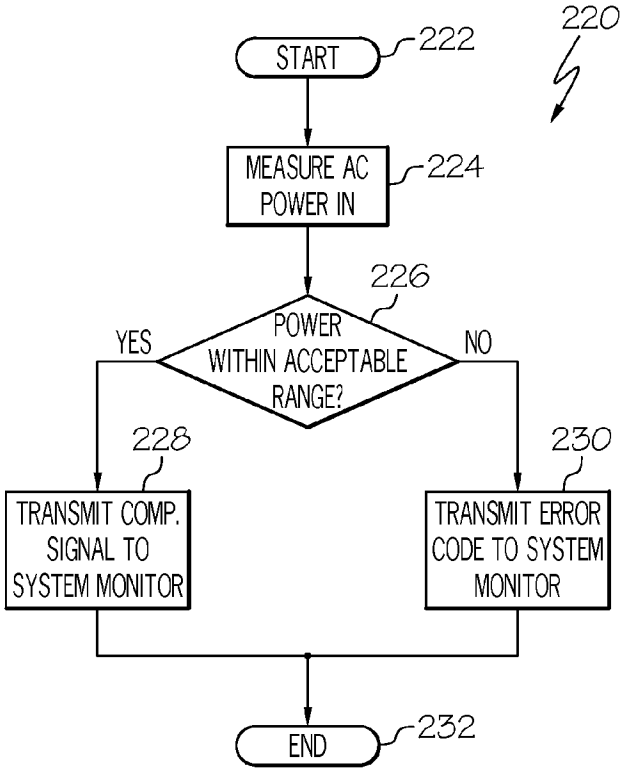
FIG. 4 is a flowchart illustrating testing power conditions of the system, according to an embodiment of the present invention.

Referring to flowchart 220 of FIG. 4, an illustrative operation for testing power conditions will now be discussed. Starting at Block 222, the system may measure the AC power source, which may include the primary power source. (Block 224). The system may determine the condition of the power source, including whether of the power provided by the AC power source is within an acceptable operational range. (Block 226). If it is determined at Block 226 that the condition is within an acceptable operational range, the ECM may transmit a signal indicative of compliance with the acceptable operational range to the system monitor. (Block 228). Conversely, if it is determined at Block 226 that the condition is not within acceptable operational range, the ECM may transmit a signal indicative of an error to the system monitor. (Block 230). After the transmitting the signal at Block 228 or Block 230, the operation may terminate at Block 232.

Figure 5:
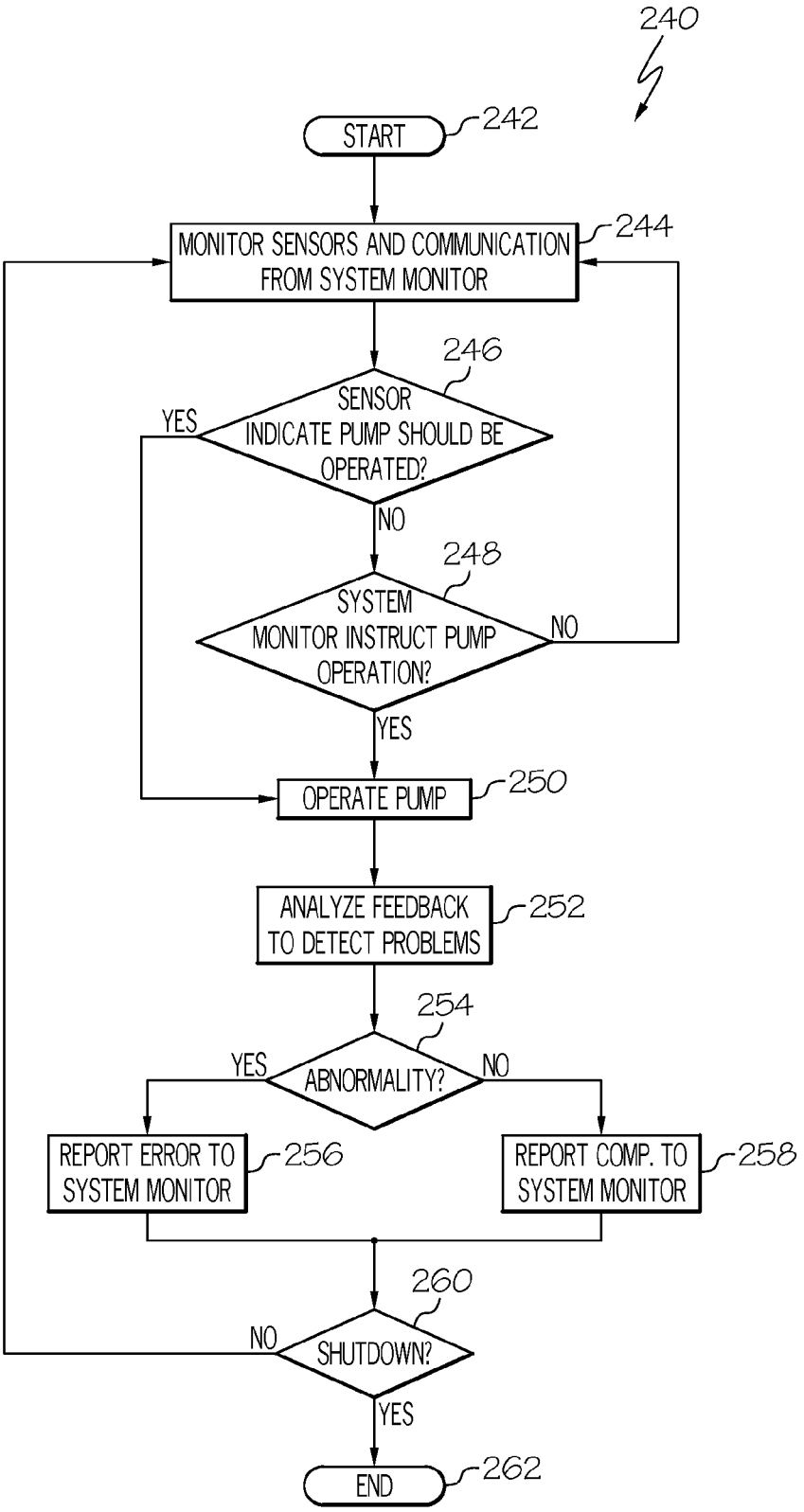
FIG. 5 is a flowchart illustrating testing sensors of the system, according to an embodiment of the present invention.

Referring to flowchart 240 of FIG. 5, an illustrative operation for testing sensors will now be discussed. Starting at Block 242, the operation may monitor sensors and communication from the system monitor. (Block 244). The operation may next determine whether a sensor indicates that a pump should be operated. (Block 246). If the decision of Block 246 is negative, the operation may determine whether the system monitor has communicated a command to operate the pump. (Block 248). If the decision of Block 248 is negative, the operation may return to Block 244 to continue monitoring the sensors and communication from the system monitor. If the decision of Block 246 or Block 248 is affirmative, a pump may be operated. (Block 250). Next, the feedback from operation of the pump may be analyzed to detect problems. (Block 252). Feedback may include a difference between starting current and running current, duration the pump operates, voltage used to operate the pump, or other conditions discussed previously in this disclosure.

The operation may determine whether an abnormality is detected at Block 254. An abnormality may relate to operating outside of an acceptable operational range. If an abnormality is detected at Block 254, the ECM may transmit a signal to the system monitor indicative of an error. (Block 256). Conversely, if an abnormality is not detected at Block 254, the ECM may transmit a signal to the system monitor indicative of compliance. After the signal has been transmitted to the remote server at Block 256 or Block 258, the operation may determine whether it should shutdown. (Block 260). If it is determined at Block 260 that the operation should not shutdown, it may return to the operation of Block 244, where it will again monitor the sensor and communication from the system monitor. If it is determined at Block 260 that the operation should shutdown, the operation may terminate at Block 262.

Figure 6:
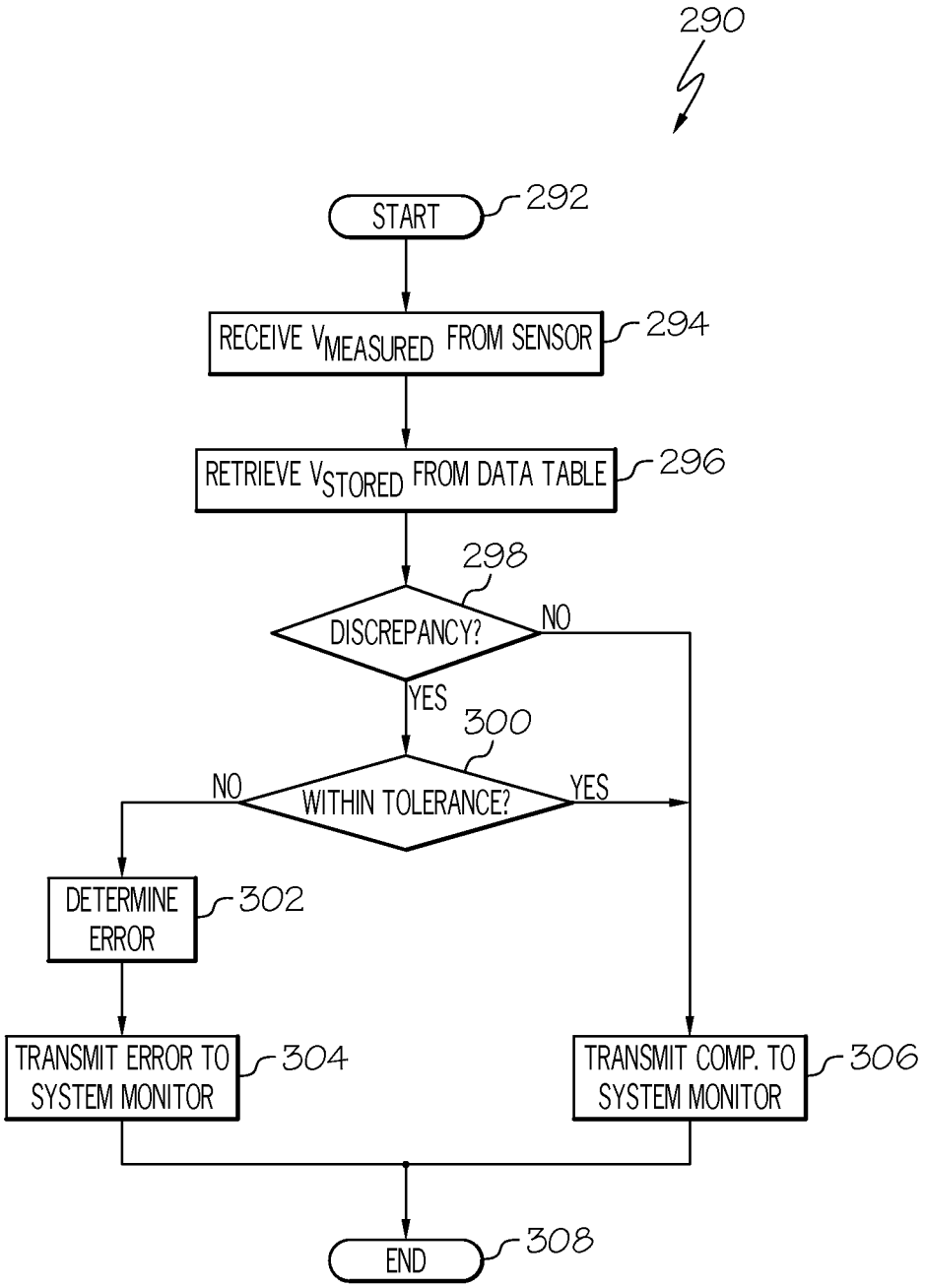
FIG. 6 is a flowchart illustrating testing voltage conditions of the system, according to an embodiment of the present invention.

Referring to flowchart 290 of FIG. 6, an illustrative operation for testing voltage conditions of the system will now be discussed. Starting at Block 292, the ECM may receive a status indicative of a measured voltage value (Vmeasured) from a sensor. (Block 294). The ECM may next receive a status indicative of a stored voltage value (Vstored) from a data table. (Block 296). One or more Vstored values may be included by, programmed into, or otherwise entered into the data table. The data table may be store on the ECM, on the system monitor, and/or in a connected database. The operation may determine whether a discrepancy exists between Vmeasured and Vstored. (Block 298). If it is determined at Block 298 that a discrepancy exists, the operation may continue to Block 300 to determine if the discrepancy is within tolerance of acceptable discrepancies.

If it is determined that Block 298 is answered in the negative or that Block 300 is answered in the affirmative, the ECM may transmit a signal to the system monitor indicative of compliance with an acceptable operational range. (Block 306). If it is determined that Block 300 is answered in the negative, the ECM may determine that an error has occurred. (Block 302). The error may include a disconnected cable, an improperly operating motor, or another condition that could cause an intolerable discrepancy. The ECM may then transmit a signal to the system monitor indicative of an error. (Block 304). After the operation of Block 304 or 306, the operation may terminate at Block 308.

Figure 7:
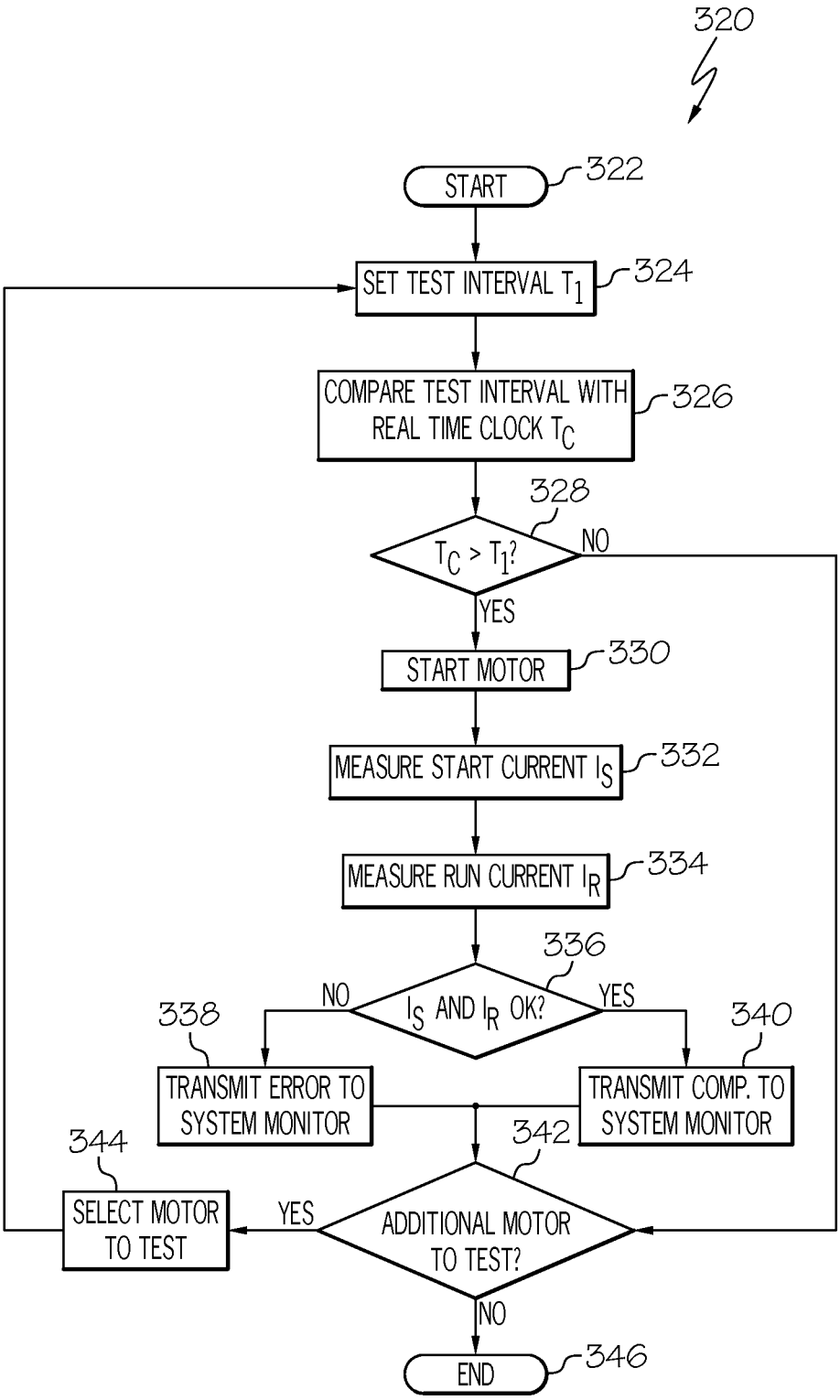
FIG. 7 is a flowchart illustrating testing a motor of the system, according to an embodiment of the present invention.

Referring to flowchart 320 of FIG. 7, an illustrative operation of testing a motor will now be discussed. Starting at Block 322, a test interval may be set as T1. (Block 324). The operation may compare the test interval with a real time clock value Tc. (Block 326). The operation may determine if Tc is greater that T1. (Block 328).

If it is determined that Block 328 is answered in the affirmative, the motor may be started. (Block 330). The ECM may measure the start current of the motor as Is. (Block 332). The ECM may also measure the run current of the motor as Ir. (Block 334). The start current Is may be compared with the run current Ir to determine whether the values are within an acceptable operational range. If it is determined at Block 336 that Ir and Is are not within an acceptable operational range, the ECM may transmit a signal to the system monitor indicative of an error. (Block 338). Conversely, if it is determined at Block 336 that Ir and Is are within an acceptable operational range, the ECM may transmit a signal to the system monitor indicative of compliance. (Block 340).

After the operation of Block 338 or Block 340, or after it is determined at Block 328 in the negative, the operation may determine whether to test an additional motor. (Block 342). If it is determined at Block 342 to test an additional motor, the operation may return to Block 324 to again set a test interval. Conversely, if it is determined at Block 324 that no additional motor should be tested, the operation may terminate at Block 346.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A system to operate, monitor, and test pump components comprising:

a system monitor; and an electronic controller module (ECM) to control, monitor, and test the pump components that is bi-directionally communicable with the system monitor via a network, the ECM being capable of initiating a test after elapse of a duration and perform ongoing monitoring of the pump components, communication between the ECM and the system monitor comprising:

receiving an operate command by the ECM from the system monitor to operate the pump components, a condition of the pump components being measurable during a test that operates the pump components, receiving a report command by the ECM from the system monitor to report a status, and transmitting the status by the ECM to the system monitor;

wherein the ECM is communicably connectable to a sensor that senses the condition;

wherein if the test determines the condition is within an acceptable operational range, the ECM communicates a signal indicative of compliance to the system monitor;

wherein if the test determines the condition is not within the acceptable operational range, the ECM communicates a signal indicative of an error to the system monitor;

wherein the system monitor performs steps comprising:

monitoring the signal provided by the ECM, analyzing the status reported by the ECM, if the status includes the error, determining whether to initiate a maintenance request in response to the error indicative of failure of the pump component affiliated with the error, if the status includes the error, determining whether to initiate the maintenance request in response to the error indicative of an abnormality prior to failure of the pump component affiliated with the error, and if the status includes the error, determining whether to report the error to a user;

wherein the pump components are manually controllable to override control by the ECM;

wherein the ECM is communicable with the system monitor via a virtual network over Internet;

wherein the pump components further comprise a primary pump connected to a primary power source of alternating current and a backup pump connected to a backup power source, wherein the primary pump that operates on alternating current is monitored and controllable by the ECM;

wherein the primary pump further comprises a first primary pump and a second primary pump; wherein the first primary pump is driven by a first power circuit of the primary power source of alternating current;

wherein the second primary pump is driven by the first primary circuit or a second primary circuit of the primary power source;

wherein the first primary pump and the second primary pump are operable simultaneously;

wherein the backup pump is driven by the primary power source, the backup power source, or a combination of the primary power source and the backup power source.

2. The system of claim 1, wherein the network comprises the Internet, wherein the system monitor comprises a database operatively connected via the network, wherein a profile is storable in the database, wherein the profile includes information relating to the ECM and the pump components operated at an installation location, wherein the profile includes historical data for determining analytics, and wherein the information and the historical data are analyzable by the system monitor to detect the abnormality.

3. The system of claim 2, wherein the ECM communicates with a router via a local area network, wherein the router directs communication between the ECM and the system monitor via the Internet, and wherein operational code of the ECM is updatable by the system monitor via the network.

4. The system of claim 2, wherein the profile is serviceable by the system monitor to monitor the ECM and report feedback to the user, wherein the profile further comprises billing information, and wherein service by the system monitor is monetized by requiring a subscription.

5. The system of claim 1, further comprising the pump components; and wherein the pump components comprise a motor includable in a pump, a battery, and a power source; wherein the motor is locatable in a sump.

6. The system of claim 1, further comprising the sensor; and wherein the sensor comprises a motor sensor, a battery sensor, a water level sensor, a power sensor, a temperature sensor, and a humidity sensor.

7. The system of claim 1, wherein a display is operatively connectable to the ECM to provide feedback and wherein a keypad is operatively connectable to the ECM to at least partially control the system.

8. A system to operate and test pump components comprising:

a system monitor, comprising an operatively connected database to store a profile comprising information about an installation location and historical data for determining analytics;

pump components, further comprising a motor includable in a pump, a battery, and a power source;

a sensor, further comprising a motor sensor, a battery sensor, a water level sensor, a power sensor, and a temperature sensor; and an electronic controller module (ECM) to control and test the pump components that is bi-directionally communicable with the system monitor via a network communicable over Internet, the ECM being capable of initiating a test after elapse of a duration and perform ongoing monitoring of the pump components, communication between the ECM and the system monitor comprising:

receiving an operate command by the ECM from the system monitor to operate the pump components, a condition of the pump components being measurable during a test that operates the pump components, receiving a report command by the ECM from the system monitor to report a status, and transmitting the status by the ECM to the system monitor;

wherein if the test determines the condition is within an acceptable operational range, the ECM communicates a signal indicative of compliance to the system monitor;

wherein if the test determines the condition is not within the acceptable operational range, the ECM communicates a signal indicative of an error to the system monitor;

wherein the ECM communicates with a router via a local area network, and wherein the router directs communication between the ECM and the system monitor via the Internet;

wherein the ECM is communicably connectable to the sensor;

wherein the ECM is communicable with system monitor via a virtual network over Internet;

wherein the pump components are manually controllable to override control by the ECM;

wherein the motor is locatable in a sump;

wherein the pump components further comprise a primary pump connected to a primary power source of alternating current and a backup pump connected to a backup power source, wherein the primary pump that operates on alternating current and the backup pump are monitored and controllable by the ECM;

wherein the primary pump further comprises a first primary pump and a second primary pump; wherein the first primary pump is driven by a first power circuit of the primary power source of alternating current;

wherein the second primary pump is driven by the first primary circuit or a second primary circuit of the primary power source;

wherein the first primary pump and the second primary pump are operable simultaneously;

wherein the backup pump is driven by the primary power source, the backup power source, or a combination of the primary power source and the backup power source.

9. The system of claim 8, wherein the system monitor performs steps comprising:

monitoring the signal provided by the ECM;

analyzing the status reported by the ECM;

if the status includes the error, determining whether to initiate a maintenance request in response to the error indicative of failure of the pump component affiliated with the error;

if the status includes the error, determining whether to initiate the maintenance request in response to the error indicative of an abnormality prior to failure of the pump component affiliated with the error; and if the status includes the error, determining whether to report the error to a user.

10. The system of claim 8, wherein the ECM is updatable by the system monitor via the network and wherein the profile is serviceable by the system monitor to monitor the ECM and report feedback to a user, wherein the profile further comprises billing information, and wherein service by the system monitor is monetized by requiring a subscription.

11. The system of claim 8, wherein a display is operatively connectable to the ECM to provide feedback and wherein a keypad is operatively connectable to the ECM to at least partially control the system.

12. A method to operate a system for operating and testing pump components, the system comprising an electronic controller module (ECM) that is bi-directionally communicable with a system monitor via a network, the method comprising:

(a) establishing a communication over the network between the ECM and the system monitor, the network being communicable via a virtual network over Internet;

(b) monitoring a sensor communicably connected to the ECM to determine a condition of the pump components;

(c) testing the pump components, wherein testing is initiated by a command from the system monitor or the ECM, the testing that is initiated by the system monitor comprising:

(i) receiving an operate command by the ECM from the system monitor to operate the pump components, the condition of the pump components being measurable during a test that operates the pump components, (ii) receiving a report command by the ECM from the system monitor to report a status, and (iii) transmitting the status by the ECM to the system monitor, wherein if the test determines the condition is within an acceptable operational range, the ECM communicates a signal indicative of compliance to the system monitor, and wherein if the test determines the condition is not within the acceptable operational range, the ECM communicates a signal indicative of an error to the system monitor; and (d) processing the status using the system monitor, further comprising:

(i) monitoring for the signal provided by the ECM, (ii) analyzing the status reported by the ECM, (iii) if the status includes the error, determining whether to initiate a maintenance request in response to the error indicative of failure of the pump component affiliated with the error, (iv) if the status includes the error, determining whether to initiate the maintenance request in response to the error indicative of an abnormality prior to failure of the pump component affiliated with the error, and (v) if the status includes the error, determining whether to report the error to a user;

wherein the pump components are manually controllable to override control by the EMC;

wherein the pump components further comprise a primary pump connected to a primary power source of alternating current and a backup pump connected to a backup power source;

wherein the primary pump that operates on alternating current is monitored and controllable by the ECM;

wherein the primary pump further comprises a first primary pump and a second primary pump;

wherein the first primary pump is driven by a first power circuit of the primary power source of alternating current;

wherein the second primary pump is driven by the first primary circuit or a second primary circuit of the primary power source;

wherein the first primary pump and the second primary pump are operable simultaneously;

wherein the backup pump is driven by the primary power source, the backup power source, or a combination of the primary power source and the backup power source.

13. The method of claim 12, wherein the system monitor comprises a database operatively connected via the network; wherein a profile is storable in the database; wherein the profile includes information relating to the ECM and the pump components operated at an installation location, historical data for determining analytics, and billing information; wherein the profile is serviceable by the system monitor to monitor the ECM and report feedback to a user requiring a subscription for monetization; wherein the ECM is updatable by the system monitor via the network; and wherein the operation of step (a) further comprises:

(i) communicating by the ECM with a router via a local area network, and (ii) directing the communication between the ECM and the system monitor via the Internet using the router.

14. The method of claim 12, wherein the pump components comprise a motor includable in a pump, a battery, and a power source; wherein the motor is locatable in a sump; and wherein the sensor comprises a motor sensor, a battery sensor, a water level sensor, a power sensor, and a humidity sensor.

15. The method of claim 12, wherein a display is operatively connectable to the ECM to provide feedback and wherein a keypad is operatively connectable to the ECM to at least partially control the system.

* * * * *